US006751430B2

(12) United States Patent
Godlove

(10) Patent No.: US 6,751,430 B2
(45) Date of Patent: Jun. 15, 2004

(54) TONER PURGING DEVELOPMENT APPARATUS AND A METHOD OF PRODUCING CUSTOM COLOR ON DEMAND USING SAME

(75) Inventor: Ronald E. Godlove, Bergen, NY (US)

(73) Assignee: Xerox Corporation, Stamford, CT (US)

( * ) Notice: Subject to any disclaimer, the term of this patent is extended or adjusted under 35 U.S.C. 154(b) by 2 days.

(21) Appl. No.: 10/176,454

(22) Filed: Jun. 20, 2002

(65) Prior Publication Data

US 2003/0235434 A1 Dec. 25, 2003

(51) Int. Cl.[7] ..... G03G 15/08
(52) U.S. Cl. ..... 399/257
(58) Field of Search ..... 399/223, 224, 399/225, 257, 258, 259, 264, 266, 290

(56) References Cited

U.S. PATENT DOCUMENTS

| | | | | | |
|---|---|---|---|---|---|
| 4,086,006 | A | * | 4/1978 | Hauser et al. | 399/257 |
| 4,113,371 | A | * | 9/1978 | Fraser et al. | 399/258 X |
| 4,451,133 | A | * | 5/1984 | Kopp et al. | 399/257 |
| 4,829,338 | A | * | 5/1989 | Whittaker et al. | 399/264 |
| 5,307,123 | A | * | 4/1994 | Aimoto | 399/257 |
| 5,899,608 | A | * | 5/1999 | Eklund et al. | 399/266 |
| 6,134,398 | A | * | 10/2000 | Grace | 399/58 |

* cited by examiner

*Primary Examiner*—Sandra Brase
(74) *Attorney, Agent, or Firm*—Tallam I. Nguti

(57) ABSTRACT

A method of, and a toner purging development apparatus for, enabling clean and efficient accomplishment of custom color on demand imaging in a xerographic color machine using two component developer material. The toner purging development apparatus includes (a) a development housing defining a sump holding two component developer material including carrier particles, and a first quantity of toner particles having a first color and a charge having a first polarity; (b) a first set of devices for charging and transporting toner laden carrier particles within the sump; (c) a second set of devices for transporting the toner laden carrier particles through a development nip of the color reproduction machine, (d) toner purging apparatus for enabling clean and efficient changing of custom color on demand within the sump by removing the first quantity of toner particles having a first color from the sump, and allowing the loading into the sump of a second quantity of toner particles having a second and different color. The toner purging apparatus as shown is mounted adjacent the movable donor member and includes a corona generating device for detoning the charged toner laden carrier particles forming a first layer of toner particles and a second layer of detoned magnetic carrier particles on the surface of the donor member. The toner purging apparatus further is connected to (e) a controller that is connected to the toner purging apparatus and has a first control mode for controlling the toner purging development apparatus in a development mode, and a second control mode for controlling the toner purging development apparatus in a toner purging mode.

25 Claims, 3 Drawing Sheets

TONER PURGING DEVELOPMENT APPARATUS AND A METHOD OF PRODUCING CUSTOM COLOR ON DEMAND USING SAME

BACKGROUND OF THE DISCLOSURE

This disclosure relates to xerographic reproduction systems or apparatus, and more particularly to a toner purging development apparatus and a method of producing custom color on demand in a xerographic color machine using same.

Xerocolography (a form of xerography for dry color imaging) is a color imaging architecture which combines multi-color xerographic development with multiwavelength laser diode light sources, with a one polygon, single optics ROS and with a polychromatic, multilayered photoreceptor to provide color imaging in either a single pass or in two passes. Inherently perfect registration is achieved since the various color images are all written at the same imaging station with the same ROS. In all three latent images are written in this manner. Two of the three images are immediately developable because their voltage levels are offset from a background level while the voltage level of the third image is at the time of its formation equal to the background voltage level. Before the third image can be developed, the photoreceptor must be exposed to flood illumination of a predetermined wavelength.

Xerography is capable of producing either highlight color or process color images in a single pass as well as in multiple passes. In conventional tri-level Xerographic process, two color or high light color images at or within a range of about 50 to 90 registered images per minute can typically be produced using particular color toner or developer dedicated development apparatus.

Conventional highlight color dry powder machines offering custom color ordinarily require changing the developer mix, either by removing it entirely from the custom color developer housing, or by removing a given housing charged with a given custom color developer and replacing that housing with another charged with the desired color. Thus an operator ordinarily will risk going through a messy process of removing one color development housing and switching it with color development housing.

There is therefore a need for a toner purging development apparatus and a method of easily producing custom color on demand in a xerographic color machine using same.

SUMMARY OF THE DISCLOSURE

In accordance with one aspect of the present disclosure, there is provided a method of, and a toner purging development apparatus for, enabling clean and efficient accomplishment of custom color on demand imaging in a xerographic color machine using two component developer material. The toner purging development apparatus includes (a) a development housing defining a sump holding two component developer material including carrier particles, and a first quantity of toner particles having a first color and a charge having a first polarity; (b) a first set of devices for charging and transporting toner laden carrier particles within the sump; and (c) a second set of devices for transporting the toner laden carrier particles through a development nip of the color reproduction machine. The toner purging development apparatus also includes (d) toner purging apparatus for enabling clean and efficient changing of custom color on demand within the sump by removing the first quantity of toner particles having a first color from the sump, and allowing the loading into the sump of a second quantity of toner particles having a second and different color. The toner purging apparatus as shown is mounted adjacent the movable donor member and includes a corona generating device for detoning the charged toner laden carrier particles forming a first layer of toner particles and a second layer of detoned magnetic carrier particles on the surface of the donor member. The toner purging apparatus further is connected to (e) a controller that is connected to the toner purging apparatus and has a first control mode for controlling the toner purging development apparatus in a development mode, and a second control mode for controlling the toner purging development apparatus in a toner purging mode.

BRIEF DESCRIPTION OF THE DRAWINGS

In the detailed description of the disclosure presented below, reference is made to the drawing, in which.

DETAILED DESCRIPTION OF THE DISCLOSURE

Figure 1:
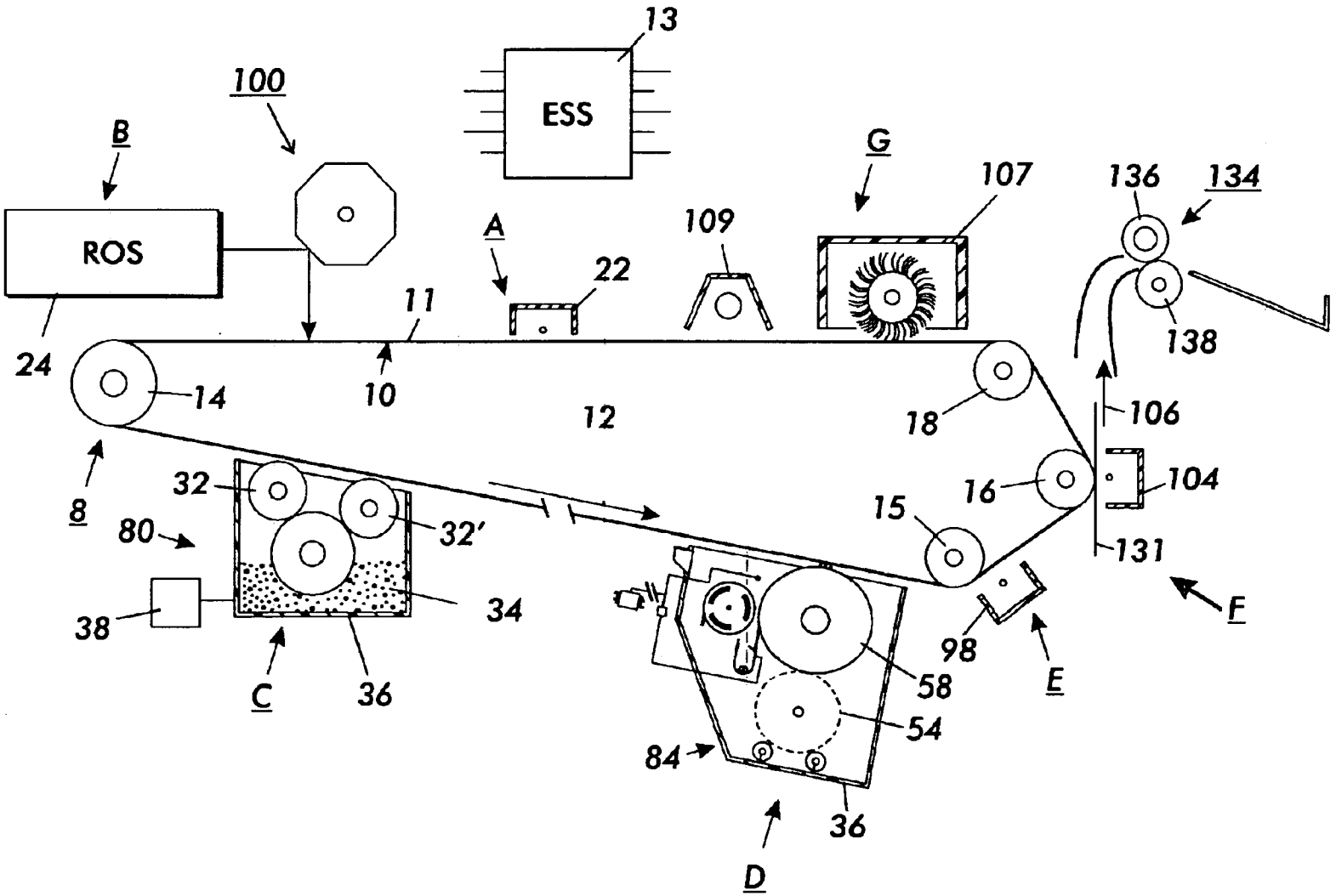
FIG. 1 is a schematic illustration of an exemplary highlight color xerographic apparatus including a color toner purging development apparatus in accordance with the present disclosure.

Referring now to the drawing, FIG. 1, there is shown generally as 100, a color xerographic apparatus, for example a highlight color xerographic apparatus of the present disclosure, for easily providing custom color on demand in accordance with the present disclosure. As shown, the highlight color xerographic apparatus 100 comprises a tri-level xerographic imager or module 8 that includes an imaging member in the form of a photoconductive belt structure 10 having a photoconductive surface 11 with an electrically conductive substrate.

A tri-level xerographic imager or module as such is a xerographic apparatus in which tri-level charge latent images (latent images including at least three different levels of charge) are formed on a charged photoconductive surface, and then appropriately developed in a single pass with at least two different colors of developer materials. Each such tri-level latent image thus includes a CAD (Charged Area Development) areas having a first level of charge for example, a DAD (Discharged Area Development) areas having a second level of charge, and background areas having a third level of charge.

In accordance with the present disclosure, quality on demand color images can be obtained efficiently in a single pass using plural development apparatus including the toner purging development apparatus 84 and method of the present disclosure (to be described in detail below). Accordingly, the tri-level module 8 thus can image with black in a first development apparatus 80, and with a different subtractive color Yellow, Magenta, Cyan, (YMC) used in the second, toner purging development apparatus 84 as desired.

A controller or electronic control subsystem (ESS) 13, preferably in the form of a programmable microprocessor, is provided for controlling the various functions and aspects of the present disclosure, including the ROS formation of CAD and DAD latent images on the module 8. The microprocessor controller 13 thus is connected to the ROS device 24 and to other components and subsystems of the machine 100, and provides necessary electrical command signals for operating all of such components including the components of the toner purging method and apparatus (to be described in detail below).

As shown in FIG. 1, in the tri-level module 8 the imaging member or belt 10 is mounted for movement past a series of xerographic process stations including a charging station A, an exposure station B, a first development station C including one development apparatus 80 using for example black color marking material. The first development station C may also include other development apparatus as required using other color marking materials or developers such as Cyan, Magenta and yellow as disclosed for example in U.S. Pat. No. 6,134,398, issued Oct. 17, 2000 to Robert E. Grace, and commonly assigned for producing a full process color image on the surface 11 of imaging member 10. Relevant portions of this patent are incorporated here by reference. As further shown, the xerographic process stations also includes the second development station D including the toner purging development apparatus 84 of the present disclosure using a custom color marking material including carrier particles and charged toner particles can easily be purged and replace in accordance with the present disclosure. The xerographic process stations next include a pretransfer charging station E, and a transfer station F.

As shown, the belt 10 moves in the direction of arrow 12 in order to advance successive portions thereof sequentially through the various processing stations which are disposed about the path of movement of the belt 10. For such movement, the belt 10 is entrained about a plurality of rollers, for example, rollers 14, 15, 16 and 18. The roller 16 may be used as a drive roller and the roller 14 may be used to provide suitable tensioning of the belt photoreceptor 10.

Initially, successive portions of belt 10 pass through charging station A, where a corona discharge device 22, such as a scorotron, corotron or dicorotron, charges the belt 10 to a selectively high uniform positive or negative potential level as determined by the charge to be placed on the toner particles in the development apparatus. Any suitable control, well known in the art, may be employed for controlling the corona discharge device 22.

Next, the uniformly charged portions of the photoreceptor surface of belt 10 are advanced through exposure station B where the uniformly charged portion of the photoreceptor surface of belt 10 is exposed to the laser based output scanning (ROS) device 24 which causes portions of the charge retentive surface 11 to remain charged or to be discharged in accordance with the output from the controller 13 through such scanning device 24.

The scanning device 24 can be a multi-level, e.g. two-level (2 bit) Raster Output Scanner (ROS). The Electronic control SubSystem (ESS) 13, for example, may convert previously stored image data into appropriate control signals for use by the ROS 24 in an imagewise fashion for exposing the belt 10. Such exposure results in the surface 11 of the photoreceptor or belt 10 containing for example, latent electrostatic image areas having three different voltage levels (tri-level), as is well known in tri-level xerography. The three voltage levels correspond to background areas and two different image areas, namely CAD image areas and DAD image areas. Two development apparatuses 80, 84 (one at each development station C and D), are thus provided for developing the two different image areas (CAD, DAD) with different color toners, to be described below.

As illustrated further in FIG. 1, the exposed or imaged portion of the belt photoreceptor 10 with a first tri-level latent image including the CAD and DAD image areas thereon, next moves to the first development station C. At development station C, one or two development apparatus (in the case of highlight color), or a plurality of development units (in the case of process color) may be provided. Usually, the first development apparatus or unit shown as 80, comprises a magnetic brush development unit, and the other development units if used comprise non-interactive scavengeless development units as disclosed for example in U.S. Pat. No. 6,134,398, issued Oct. 17, 2000 to Robert E. Grace.

For developing the first latent CAD image at $V_{CAD}$, at the development station CC, the first development unit 80, for example a magnetic brush development unit, is provided for advancing developer material 34 into contact with the CAD electrostatic latent images on the surface 11. As shown, the development unit 80 comprises at least a magnetic brush 32, 32', and a supply of two-component developer material 34, for example, black color developer or marking material, contained in a developer housing 36. The two-component developer material 34 comprises a mixture of carrier beads and black toner particles, along with additives as needed for specific applications.

For the negatively charged, CAD image development, the black toner particles are positively charged. As shown, a suitable negative developer bias is applied to the developer unit 80 from a DC power source 38. The CAD development unit 80 is typically biased about 100 volts closer to $V_{CAD}$ than $V_{white}$ (therefore at about −600 volts).

Magnetic brush development as provided by the unit 80 is an interactive unit, with the developer unit directly interacting with the image being developed. However, it is suitable for developing the CAD images because it is the first development unit in a multiple development unit, single pass process machine. As such, toner developed images do not have to be moved through and past its development fields, and hence there is no risk of scavenging and image degradation from its fields. There are however such risks with respect to the other multiple development units that could be mounted downstream of the unit 80 in such a machine, particularly as here, for developing the discharged area development, or DAD, images.

Accordingly, the discharged area development or DAD images, are preferably developed using the non-interactive scavengeless development units as disclosed for example in U.S. Pat. No. 6,134,398, issued Oct. 17, 2000 to Robert E. Grace. Such non-interactive scavengeless development units ordinarily are each biased about −100 volts closer to $V_{DAD}$ than $V_{white}$ (therefore at about −400 volts).

Figure 2:
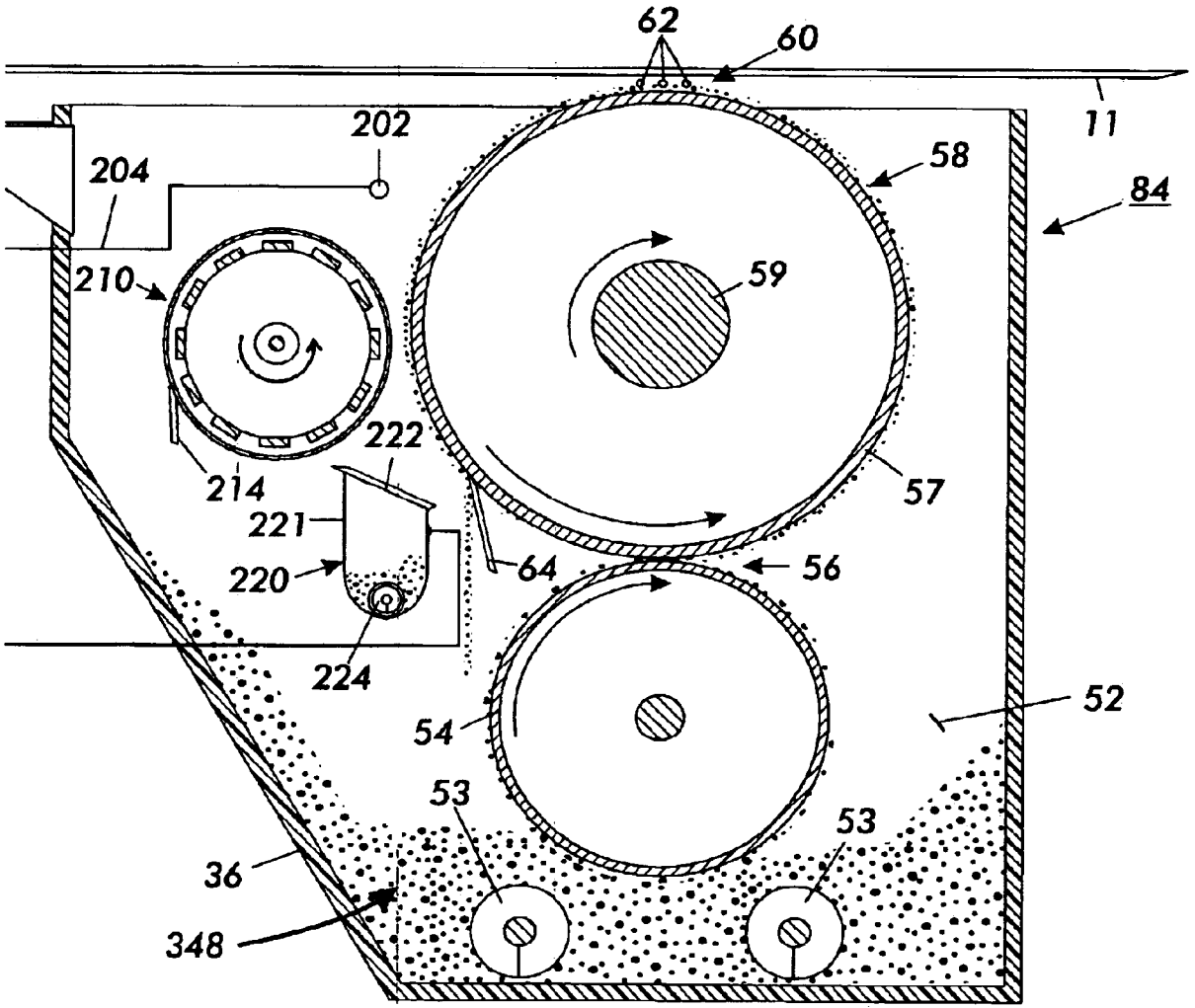
FIG. 2 is a schematic illustration of the color toner purging development apparatus in an image developing mode in accordance with the present disclosure.

Referring now to FIGS. 1 and 2, next, the belt 10 moves the tri-level image (now including the (CAD) developed image) past the development station D. As shown, the second development station D includes a second, toner purging development unit 84, in accordance with the present disclosure, that contains s desired color, for example a custom color, marking material - - - . The toner purging development unit 84 (to be described in detail below) thus appropriately deposits the desired color marking material onto the DAD image areas of the tri-level image to form a composite highlight color image for example.

Following such DAD image area development, the composite or highlight color image (CAD and DAD) is moved to a pretransfer charging station E. Because the composite or highlight color image developed appropriately on the photoreceptor 10 consists of both positive and negative marking material, a typically positive pretransfer corona discharge member 98, disposed at the pretransfer charging station E, is provided for conditioning the marking material or toner for effective subsequent transfer at a transfer station F using positive corona discharge. The pretransfer corona discharge member 98 for example can be an AC corona device biased with a DC voltage to operate in a field sensitive mode and to perform tri-level xerography pretransfer charging in a way that selectively adds more charge (or at least comparable charge) to the part of the composite tri-level image that must have its polarity reversed compared to elsewhere.

The composite or highlight color image (CAD and DAD) is next moved to and transferred at the transfer station F using a transfer corona device 104. As shown, it can be transferred directly onto an image receiving substrate such as a sheet of copy paper 131. Transfer station F includes the corona generating device 104 which sprays ions of a suitable polarity onto the backside of substrate 131. This attracts the charged toner powder forming the composite or highlight color image from the photoreceptor belt 10 onto the substrate 131.

After such transfer, the substrate 131 is moved, in the direction of arrow 106, towards a fuser assembly, indicated generally by the reference numeral 134, which permanently fuses and affixes the transferred image to substrate 131. Preferably, fuser assembly 134 comprises a heated fuser roller 136 and a pressure roller 138. Substrate 131 passes between fuser roller 136 and pressure roller 138 with the toner images contacting fuser roller 136. In this manner, the toner image is heated, fused and permanently affixed to substrate 131. After fusing, a chute, (not shown), guides the advancing substrate 131 to a catch tray, also (not shown), for subsequent removal from the machine 100 by an operator.

After the composite or highlight color image has been transferred to the substrate 131 from a portion of the photoconductive surface of belt 10, residual toner or marking particles left on such portion of the surface of the belt 10 are removed at cleaning station G. Cleaning station G can for example include a cleaning brush roll 107 as well as a pair of detoning rolls (not shown) for removing the residual toner from the brush. Other cleaning systems, such as fur brush or blade, are also suitable. Subsequent to such cleaning, a discharge lamp 109 may be used to flood that portion of the photoconductive surface of belt 10 with light in order to dissipate any residual electrostatic charge remaining on such portion, prior to the recharging of such portion for each successive imaging cycle.

Referring in particular to FIG. 2, the toner purging development unit 84 is illustrated enlarged and in greater detail. As shown, the toner purging unit 84 comprises a development housing 36 defining a sump 52 containing developer material 34B of a non-black color, for example magenta, cyan, yellow or other custom color. The developer material 34B is a two component developer material comprised of relatively heavier magnetic carrier particles "cp" and relatively lighter powdered toner particles "tp". As it is well known in the art, such developer material can be mixed and triboelectrically charged appropriately (for example positive for cp and negative for tp) within the sump 52 by mixing augers 53. During such charging, the magnetic carrier particles (cp) and the toner particles (tp) are charged oppositely and so the lighter, powdered toner particles (tp) triboelectrically adhere to and laden the heavier magnetic carrier particles (cp) to be transported therewith.

After such charging, the laden carrier particles are then picked up by a feeder magnetic roll 54. The picked up laden magnetic carrier particles are then loaded to, or transferred from the magnetic roll 54, at a nip 56 onto a donor member 58 having a magnetic core 59. The donor member 58 is shown in the form of a roller, but it is noted that it equally can be in belt. In either case, the donor member rotates and brings the toner laden magnetic carrier particles on its surface into a development nip 60.

In accordance with the present disclosure, the development unit 84 can be in a development mode in which latent images on the surface 11 that are to be developed with charged toner particles are presented to the donor member 58 for development. The development unit 84 can alternatively be in a toner purging mode, FIG. 3, to be described in detail below, in which no latent images on the surface 11 that are to be developed with charged toner particles are presented to the donor member 58 for development As shown, in the development mode, the donor member or roller 58 forms the development nip 60 with the surface 11 of the latent image bearing member 10 (also see FIG. 1). Within the development nip 60, the donor member or roll 58 presents the charged toner particles to latent electrostatic images on the surface 11 for image development. Development electrodes 62 and other means may also be provided within the nip 60 to assist in releasing charged toner particles tp in the form of a toner cloud from the magnetic carrier particles cp. The charged toner particles tp in the toner cloud are then attracted to appropriate latent image areas, e.g. DAD image areas, on the surface 11 for such image development.

In the development mode, after image development within the nip 60, the magnetic carrier particles cp on the surface of the donor member 58 are partially depleted of toner particles and so are removed by a skive 64 for return to the sump 52 for mixing and triboelectric charging.

Figure 3:
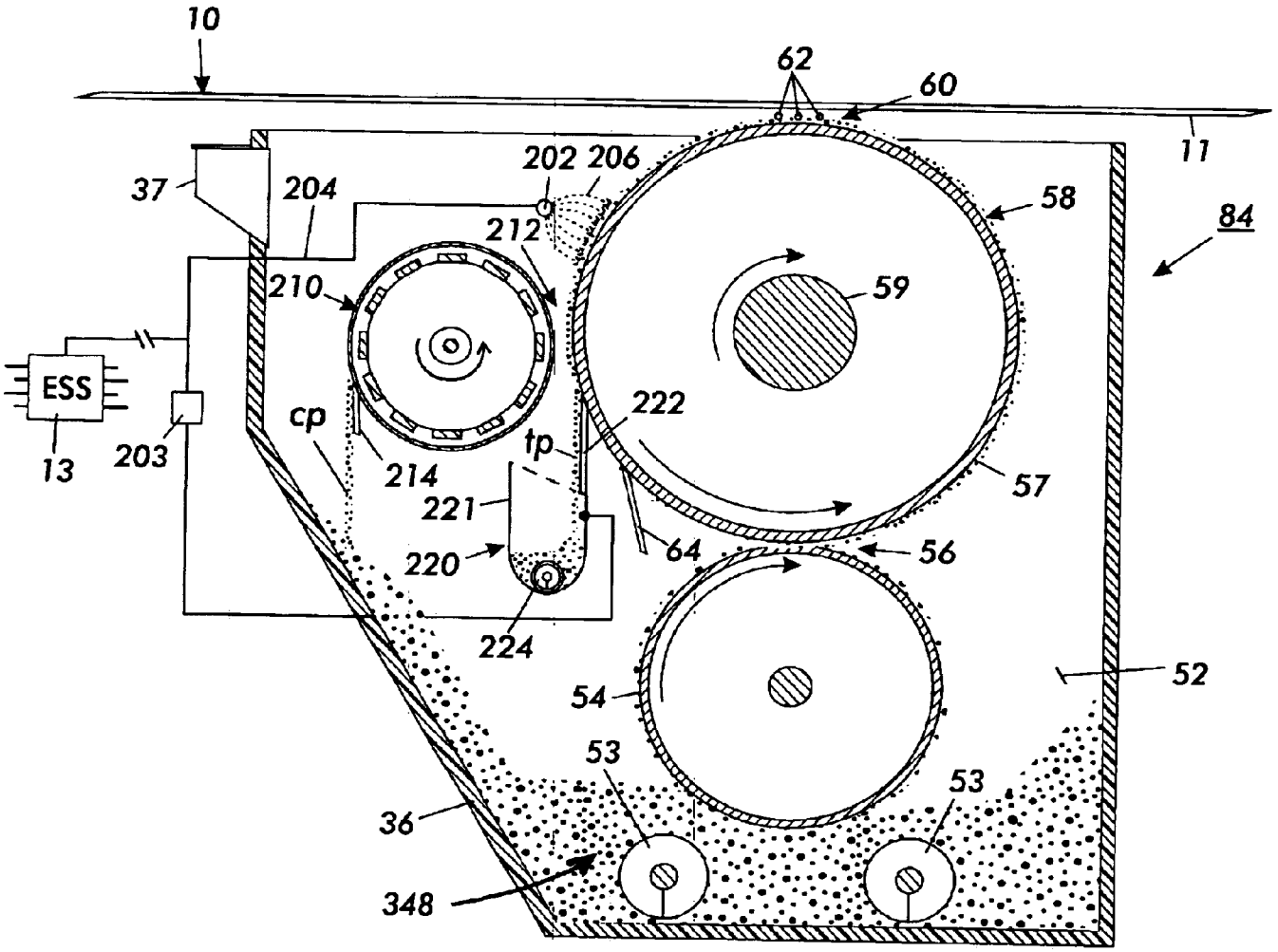
FIG. 3 is a schematic illustration of the color toner purging development apparatus in a toner purging mode in accordance with the present disclosure.

Referring now to FIG. 3, the development unit 84 is shown in its toner purging mode. For operating in the toner purging mode, the development unit 84 includes a coronode wire 202 that is located a short distance, for example a distance of about 0.100 inches away from the surface of magnetic carrier particles on the donor member 58. Because the development unit 84 is not in the development mode, the magnetic carrier particles are therefore still toner laden with charged toner particles tp. The toner particles tp can be negatively or positively charged, depending on the particular parameters of the rest of the xerographic process being used for imaging by the machine 100.

With the development unit 84 running in the toner purging mode, power 204 from a power source 203 that is controlled by the controller (ESS) 13, comprising a coronode current, and a voltage that has a polarity opposite that of the charge on the charged toner particles tp, is applied to the coronode wire 202. Since the charged toner particles have the same polarity as the power in the coronode 202, a corona 206 from the charging device or coronode wire 202 rapidly detones the magnetic carrier particles by repelling such toner particles away from their laden relationship with the magnetic carrier particles cp and away from the coronode wire 202, and therefore onto the surface of the donor member 58.

Additionally, for operating in the toner purging mode, the development unit 84 also includes a magnetic pick off roller 210 and charged toner particles skiving and removing assembly 220. The magnetic pick off roller 210 for example can be an electromagnetic having a magnetic field that when activated is stronger than the magnetic field of the magnetic core 59 of the donor member 58. As such, magnetic carrier particles cp, that have been stripped or detoned of their charged toner particles by the corona 206, will be magnetically pulled of off the surface 57 of the donor member 58, in or such magnetic carrier particles reach the pick off nip 212. The stripped magnetic carrier particles cp on the surface of the pick off roller 210 can then be skived off, for example, by a skiving device 214, for return to the sump 52 for mixing and recharging.

Meanwhile, the charged toner particles (that were repelled and stripped or detoned from the magnetic carrier particles cp and plated out onto the surface 57 of donor member 58) are moved thereon through the nip 212. Thereafter, such toner particles can be skived from the surface 57 and removed from the housing 36 by the toner skiving and removing assembly 220. As illustrated, the toner skiving and removing assembly 220 may include a trough 221 with a rotatable auger 224 therein, and a cover 222 that can also pivot as shown (FIGS. 2 and 3) to double as a skiving member against the surface 57.

Thus in operation, the development unit 84 can be run in the toner purging mode so that detoned, or toner stripped magnetic carrier particles skived from the pick of roller 210 are returned to the sump 52 over and over again to become laden with any toner particles remaining therein (which are then detoned and removed by the assembly 202, 206 and 220), until there are no more toner particles left therein. In this manner, charged toner particles tp of a given color already within the housing 36 can be separated from a two component developer material mix, such as 34B, leaving only naked magnetic carrier particles cp in the sump 52.

New toner particles of a desired color, for example a custom color, can then be added to the sump 52 to be mixed and triboelectrically charged by the magnetic carrier particles already therein. This thus allows changing of the colored toner particles, without employing the messy process of changing development housings or discarding a developer batch all together.

In an example, power comprising a coronode current of about 20 micro-Amps per inch for example, was run through the coronode wire 202 over two component developer material comprising black carrier particles laden with red toner particles. It was observed that the red two component developer material passing under the powered coronode wire 202 changed in color from red to black, indicating a significant detoning or removal of toner from the visible carrier particles in one pass. The coronode voltage was the same polarity as the toner charge.

The reason that the carrier particles were detoned so easily is that they form bead chains on the surface 57 due to the magnetic field effects of the magnetic core 59 of the donor member 58. Further, because of the counter rotation (as shown) of the magnetic core 59, the bead chains of toner laden magnetic carrier particles are caused to undergo a continuous somersaulting action as the bead chains are being moved with surface 57. Such somersaulting action exposes a large percentage of the toner in the bead chain to the coronal discharge 206 of the wire 202.

In the example, it was found that the charged toner particles plated out onto the surface of the developer or donor roll, and could then be skived off from the surface of such roll downstream from the site of coronode wire.

In other words, an aspect of the present disclosure is directed to a color toner purging development apparatus 84 for enabling clean and efficient custom color on demand imaging using two component developer material in the xerographic color machine 100 that includes other development apparatus, e.g. 80. As disclosed, the toner purging development apparatus 84 comprises (a) a development housing 36 defining a sump 52 holding two component developer material 34B including carrier particles cp, and a first quantity of toner particles tp having a first color; (b) first set of devices 53, mounted within the sump 52 for triboelectrically charging the first quantity of toner particles to adhere to and to laden the carrier particles, and device 54 for transporting the charged toner laden carrier particles within the sump 52; and (c) second set of devices 58, 59 mounted partially within the sump 52 for receiving a layer of the charged toner laden carrier particles from the first set of devices and for transporting the same through a development nip 60 of the color reproduction machine 100. The second set of devices includes a movable donor member 58 for forming the development nip 60 with a latent image bearing member 10 of the color reproduction machine 100. The toner purging development apparatus 84 also includes (d) toner purging apparatus 202, 206, 210, 220, for enabling clean and efficient changing of custom color on demand from the sump by removing the first quantity of toner particles having a first color from the sump, and allowing the loading, through opening 37 for example, into the sump of a second quantity of toner particles having a second and different color. The toner purging apparatus as shown is mounted adjacent the movable donor member 58 and includes a corona generating device 202 for detoning the charged toner laden carrier particles forming a first layer of toner particles on the surface of the donor member 58 and a second layer of detoned magnetic carrier particles over the layer of toner particles. The toner purging apparatus further is connected to (e) a controller 13 that is connected to the toner purging apparatus and has a first control mode for controlling the toner purging development apparatus 84 in a development mode, and a second control mode for controlling the toner purging development apparatus in a toner purging mode.

Thus in a xerographic color reproduction machine 100 including a controller 13 and a toner purging development apparatus 84, having a movable donor member 58 carrying a layer of charged two component developer material, and forming a development nip 60 with an image bearing member 10, there is provided a method of easily an efficiently creating custom on demand color toner images in accordance with the present disclosure. The method comprises (a) running the movable donor member of the toner purging development apparatus for carrying a layer of charged two component developer material including toner particles having a first color and a charge having a first polarity, the toner particles adhering to magnetic carrier particles; and (b) presenting no images on the image bearing member to the development nip for image development.

The method also comprises (c) applying power to a coronode device for detoning the toner particles having the first color from the magnetic carrier particles and plating them onto the surface of the movable donor member, the coronode device being positioned adjacent the layer of charged two component developer material on the movable donor member; (d) separating detoned magnetic carrier particles from the toner particles, having the first color, and plated onto the surface of the movable donor member, by picking off the detoned magnetic carrier particles using a magnetic pick off roller; (e) skiving off the toner particles having the first color the surface of the movable donor member, and removing the skived off toner particles having the first color from the toner purging apparatus; and (f) adding toner particles having a second color on demand to the detoned magnetic carrier particles through an opening 37 in the housing 36 of the toner purging development apparatus 84.

While this disclosure has been described in conjunction with a particular embodiment thereof, it shall be evident that many alternatives, modifications and variations will be apparent to those skilled in the art. Accordingly, the present disclosure is intended to embrace all such alternatives, modifications and variations as fall within the spirit and broad scope of the appended claims.

What is claimed is:

1. A color toner purging development apparatus for enabling clean and efficient accomplishment of custom color on demand imaging in a xerographic color machine using two component developer material, the toner purging development apparatus comprising:

a. a development housing defining a sump holding two component developer material including carrier particles, and a first quantity of toner particles having a first color;

b. first means mounted within said sump for triboelectrically charging said first quantity of toner particles to adhere to and laden said carrier particles, and for transporting said charged toner laden carrier particles within said sump; and c. second means mounted partially within said sump for receiving a layer of said charged toner laden carrier particles from said first means and for transporting the same through a development nip of a color reproduction machine, said second means including a movable donor member for forming the development nip with a latent image bearing member of the color reproduction machine;

d. toner purging means for enabling clean and efficient custom color on demand from said sump by removing said first quantity of toner particles having a first color and allowing loading into said sump of a second quantity of toner particles having a second and different color, said toner purging means including a pick off roller mounted adjacent said movable donor member, a corona generating device for detoning said charged toner laden carrier particles to form a first layer of only toner particles on the surface of the donor member, and an auger device for removing only skived off toner particles out of said development housing; and e. a controller connected to said toner purging means and having a first control mode for controlling said toner purging development apparatus in a development mode, and a second control mode for controlling said toner purging development apparatus in a toner purging mode.

2. The toner purging development apparatus of claim 1, wherein said movable donor member comprises a roller.

3. The toner purging development apparatus of claim 1, wherein said carrier particles in said sump are magnetic.

4. The toner purging development apparatus of claim 1, wherein said first means includes at least one mixing auger and a magnetic transport roller.

5. The toner purging development apparatus of claim 1, including a first skiving device mounted against said movable donor member for removing said layer of charged toner laden carrier particles from said movable donor member, and a second skiving device mounted against said pick off roller for removing picked off magnetic carrier from said pick off roller.

6. The toner purging development apparatus of claim 1, wherein said pick off roller is magnetic for removing said second layer of detoned magnetic carrier particles from said movable donor member.

7. The toner purging development apparatus of claim 1, wherein said toner purging means further include a toner skiving and removing assembly located adjacent said movable donor member for skiving said first layer of toner particles from said movable donor member and removing the skived off toner out of said development housing.

8. The toner purging development apparatus of claim 1, wherein said toner purging means further includes a power source for supplying power comprising a current, and a voltage having a polarity opposite to a polarity of charge on said toner particles.

9. The toner purging development apparatus of claim 7, wherein said toner purging means includes means for selectively turning said purging means off when said controller is in said development mode.

10. A xerographic color reproduction machine for easily and efficiently creating custom on color demand color toner images, the color reproduction machine comprising:

a. a movable image bearing member supported for movement in an endless path;

b. means for forming plural latent electrostatic images on said image bearing member;

c. a first development apparatus for developing a first latent electrostatic image of said latent electrostatic images using charged toner particles having a first color; and d. a second, toner purging development apparatus for enabling clean and efficient custom color on demand; the toner purging development apparatus including:

(i) a development housing defining a sump holding two component developer material including carrier particles, and a first quantity of toner particles having a first color;

(ii) first means mounted within said sump for triboelectrically charging said first quantity of toner particles to adhere to and laden said carrier particles, and for transporting said charged toner laden carrier particles within said sump; and (iii) second means mounted partially within said sump for receiving a layer of said charged toner laden carrier particles from said first means and for transporting the same through a development nip of a color reproduction machine, said second means including a movable donor member for forming the development nip with a latent image bearing member of the color reproduction machine;

(iv) toner purging means for enabling clean and efficient custom color on demand from said sump by removing said first quantity of toner particles having a first color and allowing loading into said sump of a second quantity of toner particles having a second and different color, said toner purging means including a pick off roller mounted adjacent said movable donor member, a corona generating device for detoning said charged toner laden carrier particles to form a first layer of only toner particles on the surface of the donor member, and an auger device for removing only skived off toner particles out of said development housing; and (v) a controller connected to said toner purging means and having a first control mode for controlling said toner purging development apparatus in a development mode, and a second control mode for controlling said toner purging development apparatus in a toner purging mode.

11. The xerographic color reproduction machine of claim 10, including at least one development electrode located within said development nip for assisting in the release of toner particles to form a cloud in the development nip for image development.

12. The xerographic color reproduction machine of claim 10, wherein said movable donor member comprises a roller.

13. The xerographic color reproduction machine of claim 10, wherein said carrier particles in said sump are magnetic.

14. The xerographic color reproduction machine of claim 10, wherein said first means includes at least one mixing auger and a magnetic transport roller.

15. The xerographic color reproduction machine of claim 10, including a first skiving device mounted against said movable donor member for removing said layer of charged toner laden carrier particles from said movable donor member, and a second skiving device mounted against said pick off roller for removing picked off magnetic carrier from said pick off roller.

16. The xerographic color reproduction machine of claim 10, wherein said pick off roller is magnetic for removing said second layer of detoned magnetic carrier particles from said movable donor member.

17. The xerographic color reproduction machine of claim 10, wherein said toner purging means further include a toner skiving and removing assembly located adjacent said movable donor member for skiving said first layer of toner particles from said movable donor member and removing the skived off toner out of said development housing.

18. The xerographic color reproduction machine of claim 17, wherein said toner purging means includes means for selectively turning said purging means off when said controller is in said development mode.

19. The xerographic color reproduction machine of claim 10, wherein said toner purging means further include a power source for supplying power comprising a current, and a voltage having a polarity opposite to a polarity of charge on said toner particles.

20. A method of easily an efficiently creating custom on demand color toner images in a xerographic color reproduction machine including a controller and a toner purging development apparatus having a development housing; a movable donor member carrying a layer of charged two component developer material, and forming a development nip with an image bearing member, the method comprising;

a. running the movable donor member of the toner purging development apparatus for carrying a layer of charged two component developer material including toner particles having a first color and a charge having a first polarity, the toner particles adhering to magnetic carrier particles;

b. presenting no images on the image bearing member to the development nip for image development;

c. applying power to a coronode device having a second polarity opposite said first polarity for detoning the toner particles having the first color from the magnetic carrier particles and plating them onto the surface of the movable donor member, the coronode device being positioned adjacent the layer of charged two component developer material on the movable donor member;

d. separating detoned magnetic carrier particles from the toner particles, having the first color, and plated onto the surface of the movable donor member, by picking off the detoned magnetic carrier particles using a magnetic pick off roller;

e. skiving off the toner particles having the first color from the surface of the movable donor member, and removing only the skived off toner particles having the first color out of the development housing; and f. adding toner particles having a second color on demand to the detoned magnetic carrier particles in the development housing.

21. A method of claim 20, wherein the coronode device comprises a wire.

22. A method of claim 20, wherein the power applied to the coronode device comprises an electric current and a voltage having said second polarity opposite to the first polarity of the toner particles charge.

23. A method of claim 20, including a controller for selectively operating the toner purging development apparatus in one of a toner purging mode and an image developing mode.

24. A method of claim 20, including a skiving device mounted against the magnetic pick off roller for removing and returning detoned magnetic carrier particles into a sump of the toner purging development apparatus.

25. A method of claim 20, including a trough member and an auger device therein for removing the skived off toner particles having the first color from the toner purging apparatus.

* * * * *